US010837138B2

(12) United States Patent
Norkova

(10) Patent No.: US 10,837,138 B2
(45) Date of Patent: Nov. 17, 2020

(54) MODULAR HOLDER OF TEXTILE FABRICS

(71) Applicant: Monika Norkova, Presov (SK)

(72) Inventor: Monika Norkova, Presov (SK)

( * ) Notice: Subject to any disclaimer, the term of this patent is extended or adjusted under 35 U.S.C. 154(b) by 0 days.

(21) Appl. No.: 15/182,824

(22) Filed: Jun. 15, 2016

(65) Prior Publication Data

US 2017/0362767 A1 Dec. 21, 2017

(51) Int. Cl.
*D06F 57/00* (2006.01)
*D06F 55/00* (2006.01)

(52) U.S. Cl.
CPC ..... *D06F 57/00* (2013.01); *D06F 55/00* (2013.01)

(58) Field of Classification Search
CPC ..... D06F 57/00; D06F 58/04; D06F 95/008; D06F 39/00
USPC ..... 34/239; 68/237; 223/84
See application file for complete search history.

(56) References Cited

U.S. PATENT DOCUMENTS 2,647,665 A * 8/1953 Polite ..... A45C 11/02 223/84
3,774,267 A * 11/1973 Sneider ..... D06F 95/008 24/129 B
4,617,743 A * 10/1986 Barnard ..... F26B 25/14 34/109
4,997,394 A * 3/1991 Katz ..... H01H 85/201 337/186
5,234,139 A * 8/1993 Korenstein ..... A47G 25/14 223/85
5,531,595 A * 7/1996 Koutavas ..... A61C 11/08 433/60
5,829,083 A * 11/1998 Sutton ..... D06F 95/008 68/235 R
5,987,773 A * 11/1999 Lipscy ..... D06F 59/06 34/106
6,006,933 A * 12/1999 Henning ..... B65D 41/12 215/326
6,115,936 A * 9/2000 Arlie ..... D06F 58/04 34/106
6,134,810 A * 10/2000 Stockley ..... D06F 35/006 34/600

(Continued)

FOREIGN PATENT DOCUMENTS

CA 2327515 A1 * 10/1999 ..... B65D 41/12
DE 102010027452 A1 * 1/2012 ..... F21V 21/35

(Continued)

OTHER PUBLICATIONS

Internet search of inventive concept on Jul. 18, 1017.*

*Primary Examiner* — Stephen M Gravini

(57) ABSTRACT

The invention comprises of two types of units, which can be assembled and joined together to form a chain. Front part (2) of each unit consists of oval reinforced enlargement with a boss shape (5) having a cylindrical neck (6) and a circular enlargement (9) with a reinforced ledges (7). The end part (4) of each unit consists of a formed drop-shaped opening (17), an entrance (18) and a part-circular recess (19) for receiving the neck (6). The recess (19) has a mouth shape to allow the neck (6) to pass through it with an interference fit to provide a hinge attaching each unit to another. The intermediate part (3) consists of linear and waved pinch slot (10) formed between two semi rigid side portions of the moulding which diverge away from one another so that the pinch slot (10) can be created.

3 Claims, 4 Drawing Sheets

(see point 22)

(56) References Cited

U.S. PATENT DOCUMENTS

| | | | | |
|---|---|---|---|---|
| 7,137,211 | B2 * | 11/2006 | Johnson | D06F 73/02 34/164 |
| 7,210,245 | B1 * | 5/2007 | Galli | F26B 9/003 34/201 |
| 7,921,578 | B2 * | 4/2011 | McAllister | D06F 35/00 134/10 |
| 9,234,308 | B2 * | 1/2016 | Woodson | D06F 95/008 |
| 9,677,219 | B2 * | 6/2017 | Woodson | D06F 95/008 |
| 2016/0076191 | A1 * | 3/2016 | Warren | D06F 58/04 34/239 |

FOREIGN PATENT DOCUMENTS

| | | | | | |
|---|---|---|---|---|---|
| DE | 102012009327 | A1 | * | 11/2012 | F16G 11/025 |
| EP | 2449940 | A1 | * | 5/2012 | A47L 13/38 |
| GB | 343557 | A | * | 2/1931 | B29C 33/005 |
| GB | 961990 | A | * | 6/1964 | H05K 7/1418 |
| GB | 2386111 | A | * | 9/2003 | B65D 83/0841 |
| JP | 2003276736 | A | * | 10/2003 | |

* cited by examiner

Figure 1: (see point 22)

MODULAR HOLDER OF TEXTILE FABRICS

FIELD OF INVENTION

The invention relates to a modular holder of textile fabrics designed for suspending the textile fabrics to be dried, consisting of two mutually connectable kinds of units which mutual arrangement allows variable adjustment of the holder and quick and easy use.

BACKGROUND TO THE INVENTION

Interior and exterior holders designed for suspending the textile fabrics to be dried, that were used in the past, consisted of connectable units that allowed variable adjustment of length of the holders. These holders relied on wire links which were attached to one another by inter-engaging loops at the ends of the links. The disadvantage of such holders was difficulty to set up a desired length, susceptibility to corrosion and possibility to damage the textile fabrics that were hung on the holder, because of a sharp points and edges occurring on wire link.

Known holders designed for suspending the textile fabrics to be dried that are part of the prior art, consist of connectable units made from plastic material, and include an elongated and non-linear pinch slot formed by two flexible elastic side rails that diverge at one end. The textile fabrics can be guided through this pinch slot for subsequent retention thereon. The disadvantage of these solutions is a-poor formability of the pinch slot, thereby it is difficult to hang the textile fabrics that are thicker, heavier or very thin. Use and manipulation with these holders is relatively difficult, especially for people with disabilities.

SUMMARY OF THE INVENTION

These disadvantages are removed by the proposed invention in a significant way. The invention is designed for suspending the textile fabrics to be dried by their upper, lower or both end portions.

The invention is characterized by two types of units that can be assembled and joined together to form a chain. End unit with three space holds, which can be placed on both chain sides or in any part of the chain and a function unit. Each unit comprises of an oval polymer moulding having front part, end part and an intermediate part. Front part of the unit consists of oval reinforced enlargement with a boss shape having a cylindrical neck and a circular enlargement with reinforced ledges. The intermediate part is formed with a linear and waved pinch slot. End part consists of a formed opening with a drop shape, an entrance and a recess which is slightly wider than the neck but smaller than its oval reinforced and circular enlargement. The width of the entrance to the recess is slightly less than the diameter of the neck with a boss shape. The recess has a mouth shape to allow the neck to pass through it with an interference fit to provide a hinge attaching each unit to another. The intermediate part of the function unit is formed with linear and waved pinch slot formed between two semi rigid side portions of the moulding which diverge away from one another so that the pinch slot can be created. The pinch slot opens up in the centre of the unit to define part of an opening through which the upper end, lower end or both ends of a textile fabric can be guided into for retention inside the pinch. The pinch is formed between a two pairs of inner ribs which are spaced inwardly of outer ribs. The inner ribs are connected to the adjacent outer ribs by two pairs of inclined, spaced bars. Between the ribs is the relief of the unit.

The preferred embodiment of the invention is that at least one side portion of the moulding that forms the pinch slot has a notch, thereby reducing the thickness of at least one site portion of the moulding in contact with the textile fabric. The notch can pass and longitudinally reproduce the linear and waved pattern of the pinch slot. It is preferred that one side portion of the moulding that forms the pinch slot has a width in accordance with the width of the intermediate part of the function unit and the opposite side portion of the moulding that forms the pinch slot has a thinner edge. This leads to a spot water discharge and thus to a partial spot drying of the textile fabric inserted into the pinch slot. The blade formed by the notch causes a greater spot pressure, wherein the remainder of the function unit has the thickness necessary for the transfer of the pulling force in the chain. Thanks to the notch, a soft, thin fabric, as well as a strong, heavy material, is easier to retain in the function units.

The advantage of the invention resides in the fact that the function unit is designed as oval with parallel sides, which has a grid structure for better flexibility of the pinch slot itself. More robust structure of the function unit provides the opportunity to hang even the heavier textile fabrics. The advantage also resides in that the pinch slot for the textile fabrics begins in the middle of a function unit so that it is possible for the textile fabrics of greater thickness to be inserted into the pinch slot. However, the pinch slot is narrowed to the point, that it is possible for a very light and thin fabrics to be inserted into the slot. The invention allows easy use even for people with disabilities.

The invention is designed for both indoor and outdoor use, its main benefit is practicality, linear adjustability, the low-space, easy to manufacture, installation, maintenance and use, as well as versatility and aesthetics. The invention also eliminates the need to use conventional textile fabrics pegs. The invention can be arranged in one straight line or in the ring. The advantage of using the invention in the external and internal environment consists in saving the space and in the possibility to tune the invention with exterior and interior, for example in terms of material, color or size, which can be changed as required. The invention can be used in residential areas, homes, work, schools, sports clubs, health, culinary, social and other facilities.

DETAILED DESCRIPTION

Figure 3:
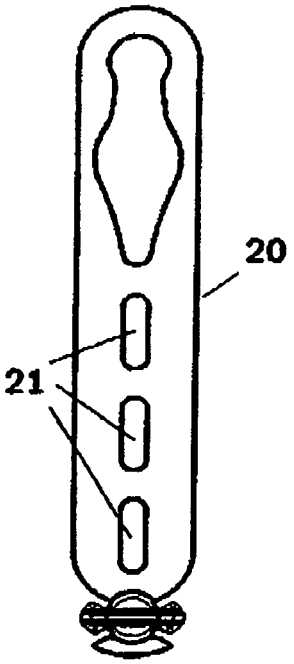
FIG. 3 shows a general view of the modular holder of textile fabrics end unit from above.
Figure 4:
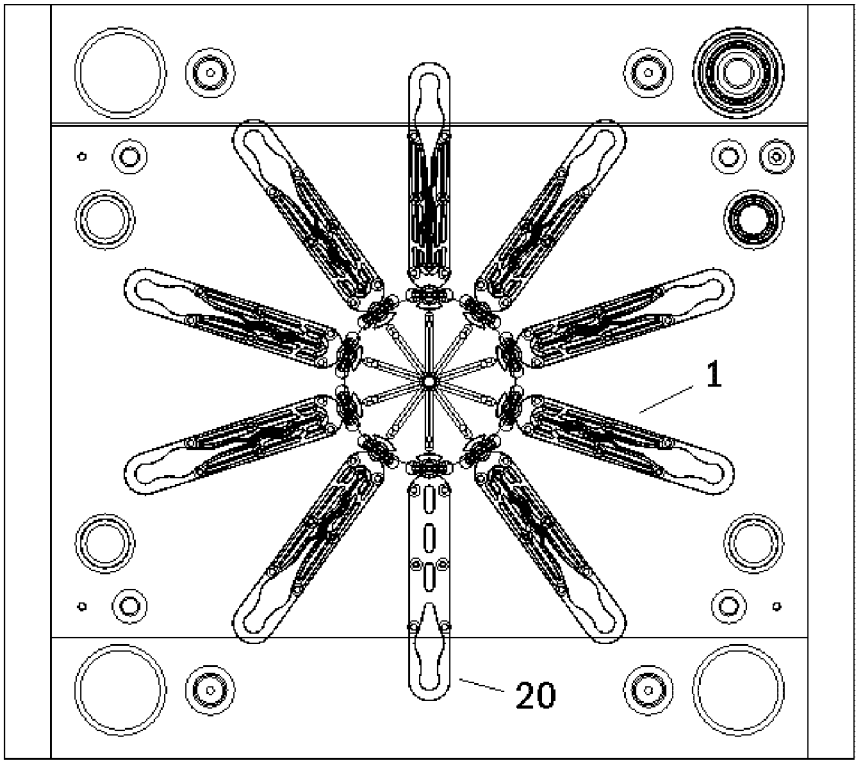
FIG. 4 shows how the function units described can be made simultaneously from an injection moulding process, together with one end connector moulded at the same time.

Modular holder of textile fabrics comprises two types of units, which can be assembled and joined together to form a chain. Modular holder of textile fabrics comprises function unit 1 showed in FIG. 1 and an end unit 20 showed in FIG. 3, which can be placed on both ends of the chain or in any other part of the chain. Every unit of the invention consist of oval polymer moulding having a front part 2, intermediate part 3 and a end part 4. Function unit 1 and an end unit 20 are generally injection-moulded from a resiliently flexible plastics, while both units are moulded at the same time. In this embodiment the resiliently flexible plastic can be polyethylene, polypropylene or ASA. Function unit 1 and an end unit 20 are made in any size, in this particular embodiment every unit is approximately 125 mm long, with none width tampering, 13.5 mm high in the front part 2 and 4 mm thick along the remainder of its length constituted by an intermediate part 3 and an end part 4.

Figure 1:
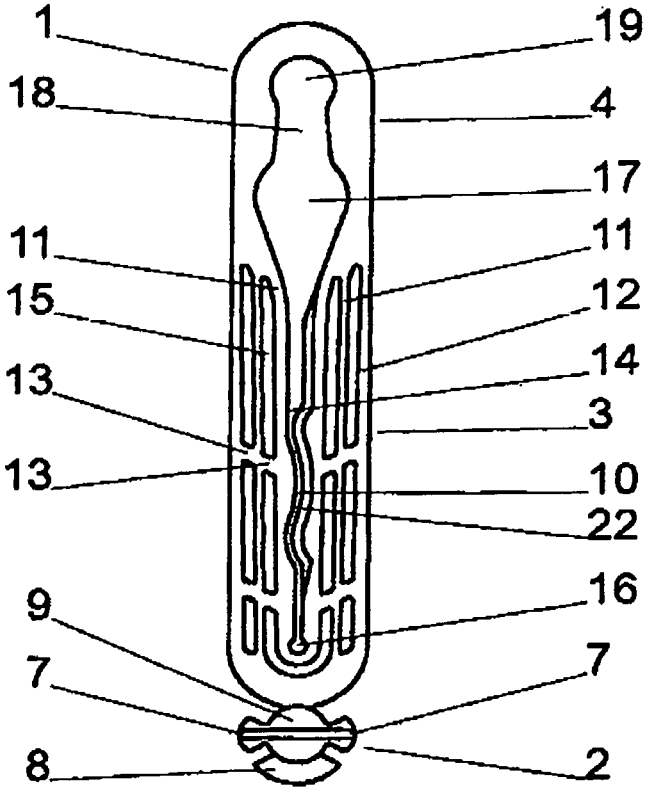
FIG. 1 shows a general view of the modular holder of textile fabrics function unit from above.
Figure 2:
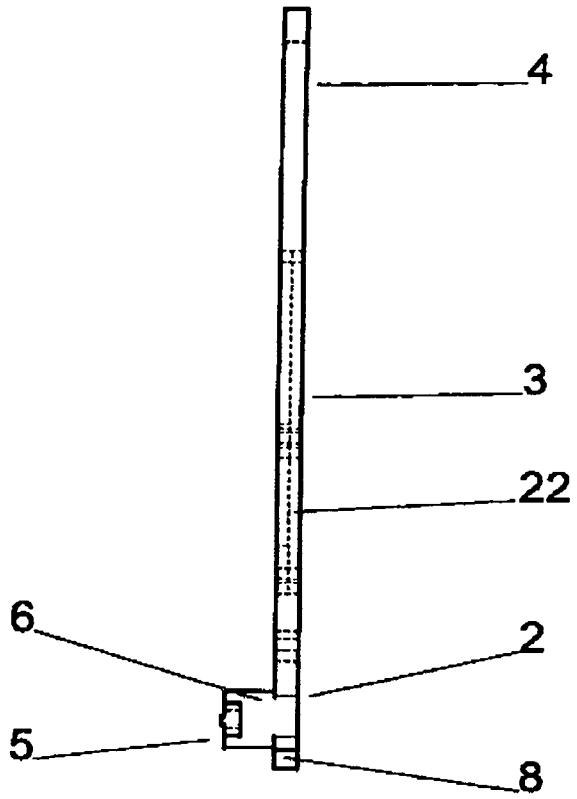
FIG. 2 shows a side view of the modular holder of textile fabrics function unit.

According to FIG. 2 the front part 2 of the function unit 1 and an end unit 20 is formed with a boss shape 5 having a cylindrical neck 6 and a circular enlargement 9. The boss shape 5 has reinforced ledges 2 as is shown in FIG. 1. A shelf 8 extends from the neck 6 on the opposite side of the neck.

The intermediate part 3 of the function unit 1, as is shown in FIG. 1, is characterized by flexible pinch slot 10 having a linear and waved portion, through which the upper end, lower end or both ends of textile fabrics can be guided through, so that the textile fabric is retained. The pinch slot 10 is formed between two semi rigid side portions of the moulding which diverge away from one another so that the pinch slot can be created. The pinch slot 10 opens at one end into a circular hole 16 and the other end is opening in the centre 14 of the function unit 1.

The pinch slot 10 is formed between a two pairs of inner ribs 11 which are spaced inwardly of outer ribs 12. The inner ribs 11 are connected to the adjacent outer ribs 12 by two pairs of inclined, spaced bars 13. Between the inner ribs 11 and outer ribs 12 is the relief 15 of the function unit 1. The width of the pinch slot 10, which has a linear and waved part, can be adjusted and manufactured as needed, in this particular embodiment the minimum width is about 0.35 mm and maximum width is about 0.65 mm. One side portion of the moulding that forms the pinch slot 10 has a notch 22. The notch 22 forms the blade, which is in contact with inserted textile fabric.

The end part 4 of the function unit 1 and an end unit 20, as is shown in FIG. 1, consists of drop-shaped opening 17 and an entrance 18 to a part-circular recess 19. The diameter of a part-circular recess 19 is slightly wider than the diameter of the cylindrical neck 6, but smaller than a diameter of a circular enlargement 9. The entrance 18 is slightly smaller than the cylindrical neck 6 but formed in a way that the neck 6 can be guided through, so that two units connect with each other. The drop-shaped opening 17 is large enough, so that the boss shape 5 can be guided through. The neck 6 can be then snapped through the entrance 18 to the recess 19.

The end unit 20 has a three space holds 21, which enable cord to be attached to the end units 20 of the chain. The end unit 20 has a boss shape 5 and a part-circular recess 19, which is the same as in function unit 1 which enable the end unit 20 to be connected to the function unit 1.

While the invention has been described herein with reference to particular embodiments, these have been presented by way of example only. The invention may be varied without departing from the inventive concept.

The invention claimed is:

1. Modular holder of textile fabrics comprising a chain of function units (1) which consist of oval polymer moulding having a front part (2) with a boss shape (5) having a cylindrical neck (6) and a circular enlargement (9), an intermediate part (3) and an end part (4) with a drop-shaped opening (17) and an entrance (18) to a part-circular recess (19), which is slightly wider than the cylindrical neck (6), but smaller than the circular enlargement (9), while the entrance (18) is smaller than the cylindrical neck (6) but shaped in a way that the cylindrical neck (6) can be guided through, so that the function units (1) can be connected, while the intermediate part (3) has a flexible pinch slot (10) with linear and waved part formed between two semi rigid side portions of the moulding, which at one end of the moulding diverge away from one another; and wherein the flexible pinch slot (10) opens up in a centre (14) of the function units (1) and into a circular hole (16) and is formed between two pairs of inner ribs (11) which are spaced inwardly of adjacent outer ribs (12) and are connected to the adjacent outer ribs (12) by two pairs of inclined, spaced bars (13);

wherein between inner ribs (11) and adjacent outer ribs (12) is a relief (15);

wherein the boss shape (5) in the front part (2) of oval polymer moulding has the cylindrical neck (6) with the circular enlargement (9) with reinforced ledges (7) on one side of the cylindrical neck (6) and a shelf (8) on other side of the cylindrical neck (6).

2. Modular holder of textile fabrics in accordance with claim 1, wherein at least one side portion of the moulding that forms the pinch slot (10) has a notch (22), which reproduces a linear and waved pattern of the pinch slot (10) while forming a blade that is thinner than a width of the function units (1) in theirs intermediate part (3).

3. Modular holder of textile fabrics in accordance with claim 1, further comprising of at least one end unit (20) on an end of the chain of the function units (1);

wherein the end unit (20) has a three space holds (21) in a centre of the end unit (20).

* * * * *